US005372121A

United States Patent [19]

Castillo et al.

[11] Patent Number: 5,372,121

[45] Date of Patent: Dec. 13, 1994

[54] COOKTOP GRATE WITH IMPROVED STABILITY

[75] Inventors: Daniel J. Castillo; Michael S. Woods, both of Louisville, Ky.

[73] Assignee: General Electric Company, Louisville, Ky.

[21] Appl. No.: 235,862

[22] Filed: May 2, 1994

[51] Int. Cl.[5] ..... F24C 15/10

[52] U.S. Cl. ..... 126/214 R; 126/215; 126/39 B

[58] Field of Search ..... 126/214 R, 214 C, 215, 126/211, 214 D, 39 R, 39 B, 212, 220, 221, 152 R

[56] References Cited

U.S. PATENT DOCUMENTS

| | | | |
|---|---|---|---|
| 2,429,279 | 10/1947 | Salter et al. | 126/214 R |
| 2,473,478 | 6/1949 | Stevens | 126/214 |
| 2,861,563 | 11/1958 | Jensen | 126/214 |
| 3,078,836 | 2/1963 | Clark | 126/214 R |
| 3,170,457 | 2/1965 | Bucellato | 126/214 |
| 3,263,676 | 8/1966 | Kamin | 126/215 |
| 3,416,513 | 12/1968 | Fischer et al. | 126/215 |
| 3,871,356 | 3/1975 | Saponara | 126/215 |
| 4,089,321 | 5/1978 | Ondrasik, II | 126/215 |
| 4,261,327 | 4/1981 | Kamin | 126/215 |
| 4,593,677 | 6/1986 | Sargunam | 126/214 C |

FOREIGN PATENT DOCUMENTS

| | | |
|---|---|---|
| 1135004 | 4/1957 | France . |
| 467266 | 10/1928 | Germany . |

*Primary Examiner*—James C. Yeung
*Attorney, Agent, or Firm*—H. Neil Houser

[57] ABSTRACT

A cooktop has a recessed portion surrounding a burner opening. The recessed portion includes bosses with grate supporting surfaces below the upper surface of the cooktop, and dams with vertical inner surfaces. A grate has a rectangular base with a vertical side wall and a bottom edge. The grate is mounted in the recessed portion, aligned with the burner opening, with the base bottom edge resting on the grate supporting surfaces of the bosses and with the grate side wall adjacent the vertical inner surfaces of the dams. The base includes tabs aligned with the dams and extending downwardly to provide greater height at the portions of the side wall aligned with the dams.

5 Claims, 3 Drawing Sheets

Fig. 1
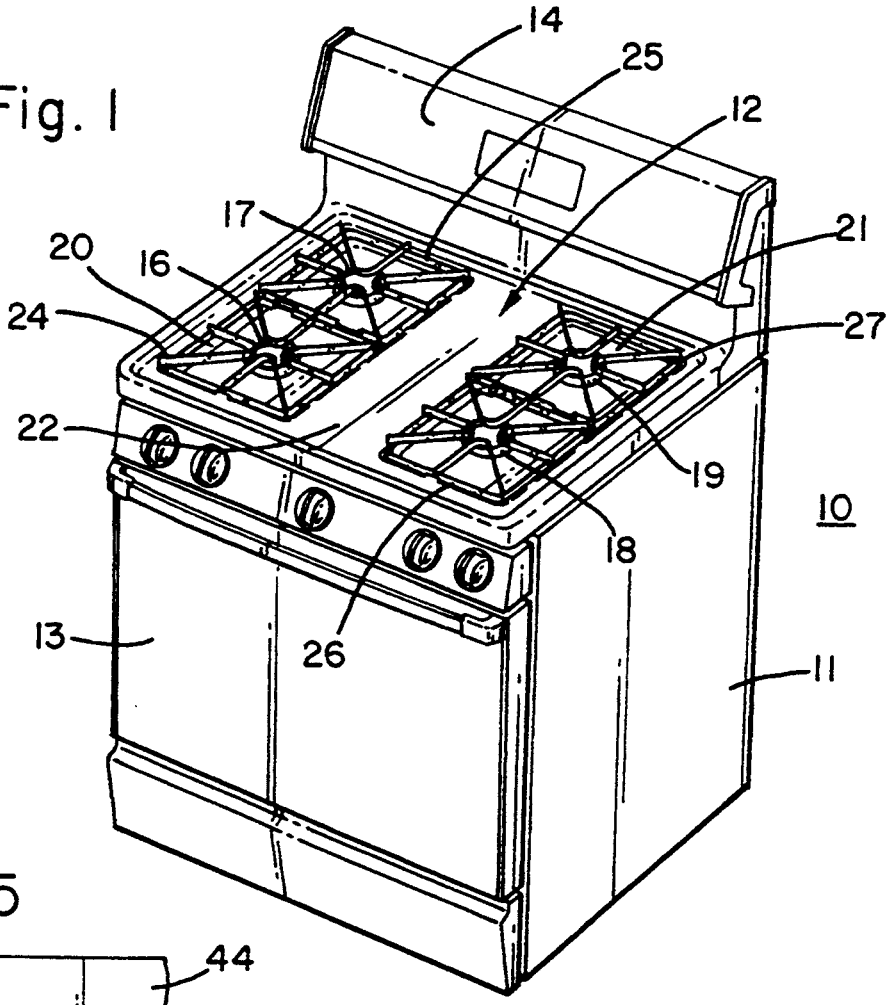
Fig. 5
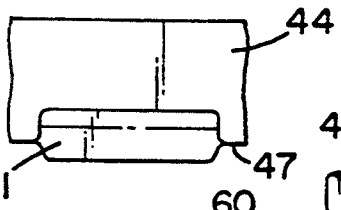
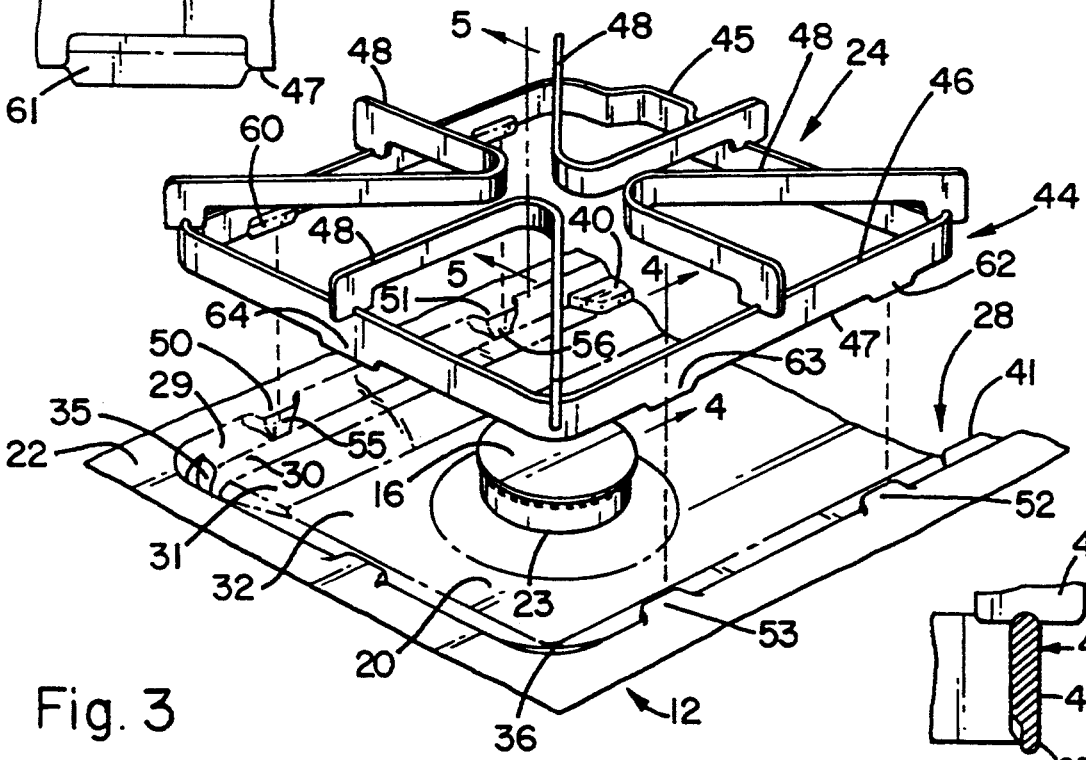
Fig. 3
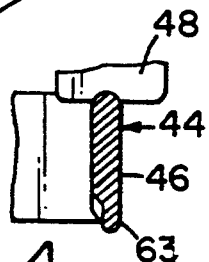
Fig. 4

COOKTOP GRATE WITH IMPROVED STABILITY

BACKGROUND OF THE INVENTION

This invention relates to utensil supporting grates of cooktops and, more particularly, to a cooktop/grate combination which provides greater stability of the grates.

For many years grates were mounted to cooktops by inserting depending fingers or knobs of the grate through mating openings in the cooktop. This had a number of drawbacks. For example, it required that holes extend through the cooktop, providing sites for possible rusting of the body of the cooktop.

More recently the burner openings have been surrounded by relatively large recessed areas and the grates have been mounted within these recessed areas. In one embodiment the grate includes an annular base with a vertical outer surface and a bottom edge. The recessed area of the cooktop includes spaced apart bosses with horizontal upper surfaces that support the bottom edge of the grate base. The recessed area also includes dams with vertical inner surfaces that contact the outer surface of the grate base to restrain the grate should a lateral force tend to slide the grate out of the recessed area.

At times such dams do not exert sufficient restraining force on the grates, which then can slide out of the recessed area. A significant reason for such sliding is that the dams do not have sufficient vertical overlap with the grate base. This results from the restraints on the vertical dimensions of various elements.

Grates must support heavy utensils when at high temperatures. Thus they are made of relatively large amounts of expensive materials. Thus it is desirable to minimize the size of the grate. At the same time, for optimum operation of the burner flame, the grate must support the utensil at a predetermined distance above the burner. For this reason, the grate does not rest on the bottom of the recessed area. Rather bosses are formed part way up the peripheral wall of the recess and the grate is supported on the bosses. This enables the base of the grate to have a smaller height and use less material.

In order to restrain the grates from sliding out of the recessed areas substantially vertical opposing surfaces are provided. Essentially the entire periphery of the grate base can be used as one vertical surface, while the other must be formed along the periphery of the recessed area. The recessed areas usually are large in cross-section and deep. Attempts to draw such a recessed area with a generally vertical wall into the steel or other metal forming the cooktop leads to excessive failures of the metal. Therefore, individual small dams, with substantially vertical inner surfaces, have been formed in spaced apart relationship about the peripheral portion of the recessed area. These dams and the corresponding portions of the grate base form the opposing vertical surfaces. In some instances the area so provided is not sufficient.

One possible solution would be to remove or shorten the bosses. However, since the top of the grate must be at least a predetermined distance above the burner, this would require greater height of the grate base and would greatly increase the cost of each grate.

An object of the present invention is to provide an improved cooktop and grate assembly.

Another object is to provide such an assembly in which the grates are resistant to sliding out of the mating recess in the cooktop.

It is yet another object of this invention to provide such an improved cooktop and grate assembly that does not involve any increase in material.

SUMMARY OF THE INVENTION

In accordance with one embodiment of the present invention there is provided a cooktop having an upper surface with at least one burner opening therethrough. The cooktop includes an area recessed downwardly of its upper surface and surrounding the at least one burner opening. The peripheral portion of the recessed area includes a plurality of spaced apart bosses with horizontal grate supporting surfaces positioned below the upper surface of the cooktop. The peripheral portion also includes a plurality of spaced apart dams with substantially vertical inner surfaces.

At least one grate has an annular base, with a substantially vertical outer surface and a bottom edge, and a plurality of utensil supporting members extending inward of the base. The grate is positioned within the recessed area, overlying the at least one burner, and with the grate base bottom edge resting on the grate supporting surfaces of the bosses and with the base outer surface adjacent the inner surfaces of the dams. The grate includes a plurality of tabs spaced apart along the base and aligned with the dams. The tabs extend downwardly to increase the height of the base at each dam.

BRIEF DESCRIPTION OF THE DRAWINGS

FIG. 1 is a perspective view of a gas range incorporating one embodiment of the present invention.

FIG. 3 is an exploded fragmentary perspective view of the front portion of the cooktop recessed area illustrated in FIG. 2.

FIG. 4 is a fragmentary cross section view of the grate as seen along line 4—4 in FIG. 3.

FIG. 5 is a fragmentary cross section view of the grate as seen along the line 5—5 in FIG. 3.

DETAILED DESCRIPTION OF PREFERRED EMBODIMENT

Figure 2:
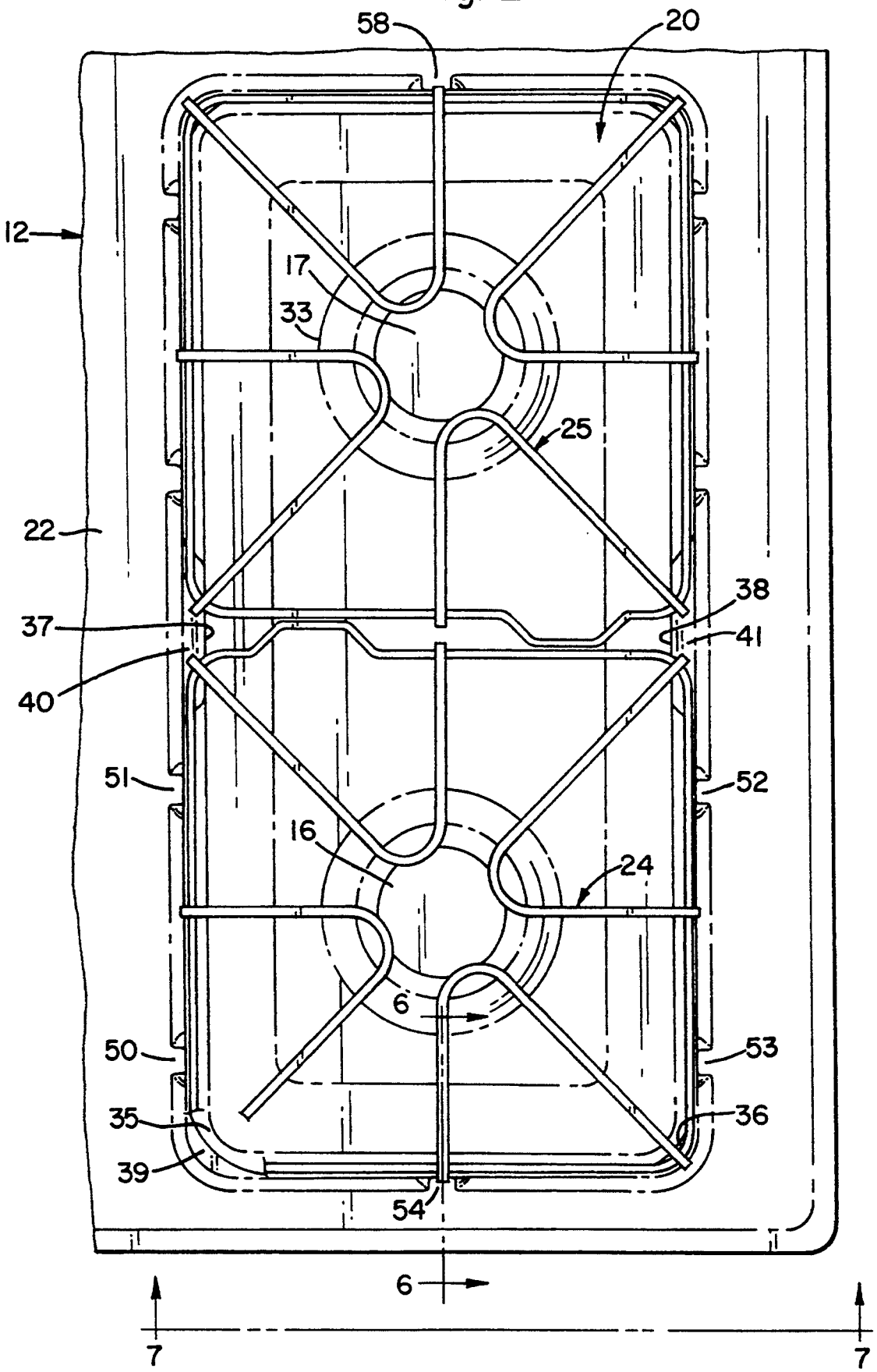
FIG. 2 is a plan view of a portion of the cooktop of the range of FIG. 1, showing certain details of a recessed area and the grates received therein.
Figure 7:
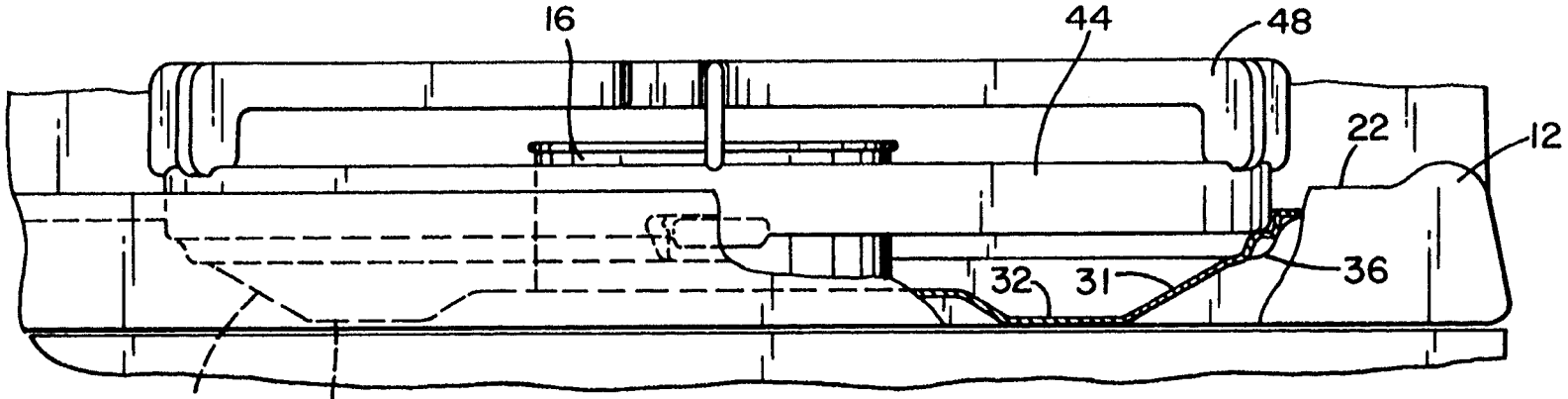
FIG. 7 is a fragmentary cross section view as seen along line 7—7 in FIG. 2.
Figure 6:
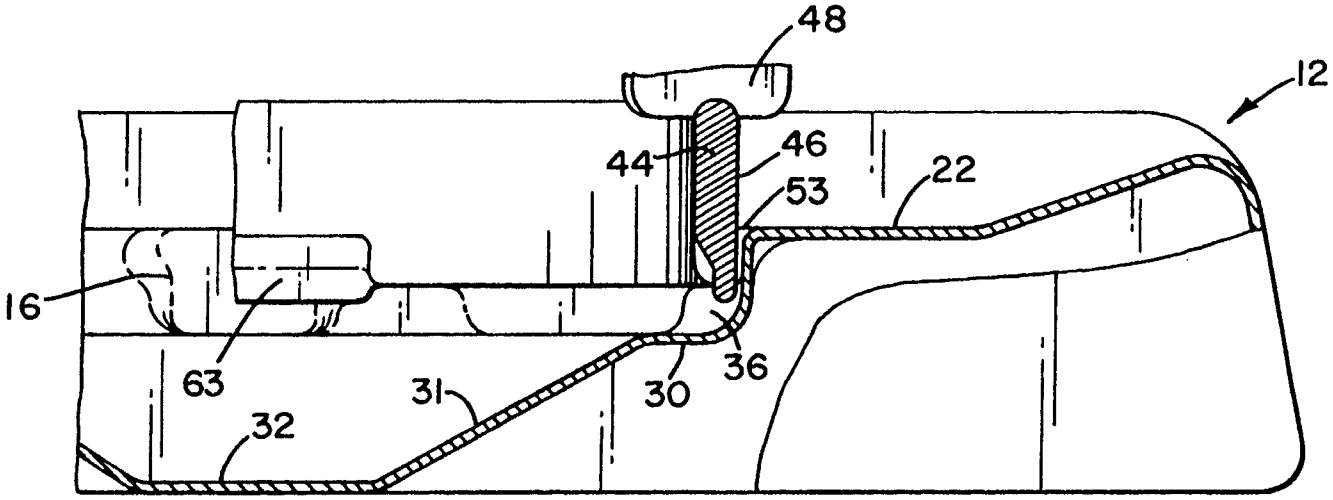
FIG. 6 is a fragmentary cross section view as seen along line 6—6 in FIG. 2.

Turning now to the drawings, and particularly to FIG. 1, there is shown for illustrative purposes a free standing gas range 10 with an outer body or cabinet 11 that incorporates a generally rectangular cooktop 12. An oven, not shown, is positioned below the cooktop and has a front-opening access door 13. A range backsplash 14 extends upward of the rear edge of the cooktop and contains various controls for both the cooktop and oven. It will be understood that the present invention is applicable, not only to cooktops which form the upper portion of a range, but to other forms of cooktops as well, such as free standing cooktops that are mounted in kitchen counters.

The cooktop 12 includes four gas fueled burners 16–19 which are positioned in spaced apart pairs 16–17 and 18–19 positioned adjacent each side of the cooktop.

Each pair of burners is surrounded by a recessed area, 20–21 respectively, of the cooktop. The recessed areas are positioned below the upper surface 22 of the cooktop and serve to catch any spills from utensils being used with the cooktop. Each burner extends upwardly through an opening in the cooktop, such as opening 23 for burner 16 is shown in FIG. 3. Separate utensil supporting grates 24–27 are positioned within the recessed areas 20–21 and overlie the burners 16–19 respectively.

It will be understood that each burner 16–19, each recessed area 20–21 and each grate 24–27 conveniently is substantially identical to each other burner, recessed area and grate respectively. Therefor, for the sake of simplicity the following discussion will concentrate on burner 16, recessed area 20 and grate 24.

Referring now particularly to FIGS. 2 and 3, the recessed area 20 is in the shape of a rectangle with rounded corners surrounding both of burners 16–17. The peripheral portion 28 of area 20 includes a first annular wall 29 which curves downward and inward from the cooktop upper surface 22, a second annular wall 30 which is substantially horizontal, and a third annular wall 31 which curves downward and inward from the horizontal wall 30. The bottom of the recessed area is a generally flat wall 32 which includes the opening 23 for burner 16 and an opening 33 for burner 17. As the recessed area catches spills from cooking utensils a small ridge may be formed in the bottom wall 32 around each of the burner openings so that small spills will be contained in the recessed area and not run through the burner openings to the area between the cooktop and the oven.

A number of bosses formed in the cooktop project upward of the second wall 30. More specifically a small boss is provided at each corner of the recessed area, such as 35 and 36 at the front corners of recessed area 20. In addition elongated bosses are provided at the mid-point along each side of each recessed area, such as 37 and 38 for area 20. Each boss includes a flat, horizontal upper surface, such as those shown at 39–41 for bosses 35, 37–38 respectively. The boss upper surfaces are positioned between the second wall 30 and the upper surface 22 of cooktop 20.

Grate 24 includes an annular, base 44 which is in the form of an open square with a small protrusion 45 adjacent one corner. These protrusions keep the two grates in a common recessed area properly spaced apart. The base is formed from a continuous strip of metal, such as low carbon steel, annealed; that is bent into the desired shape and then has its ends welded to form a unitary piece. The base includes a substantially vertical outer surface 46 and a bottom edge 47. A number of utensil supporting members 48 are welded to the top of base 44. The supporting members can take any of a number of well known shapes and conveniently are made of the same material as the base.

Each grate is positioned in a recessed area overlying a corresponding burner. Referring to FIGS. 2 and 3, the bottom edge 47 of grate base 44 rests on the horizontal upper surfaces 39–41 of the bosses 35–38. The position of the boss upper surfaces and the height of the grate base are integrated so that the top of the utensil supporting members 48 is at a predetermined height above the top of burner 16. This assures optimum combustion of the gas. The bosses could be eliminated and the bottom edge 47 of the grate permitted to rest on horizontal second wall 30. However, this would require a significant increase in the material used in the grate. Such material is expensive as the grate must support heavy utensils while at high temperature.

A force generally parallel to the grate, as that exerted when an utensil is slid across the grate, will tend to cause the grate to slide out of the recessed area. To impede such sliding it would be desirable to make the first peripheral wall 29 substantially vertical so that it would bear against the outer surface 46 of the grate base 44. However, the recessed areas are sufficiently large that drawing the first wall in a substantially vertical configuration causes many of the walls to rupture with the result that those cooktops must be scraped. Therefore, a number of small dams, such as those at 50–54, are formed in first wall 29. More specifically, dams 50–51 are spaced apart between corner boss 35 and the adjacent side boss 40, dams 52–53 are spaced apart between corner boss 36 and side boss 41, while dam 54 is positioned between corner bosses 35–36. Each of the dams includes a substantially vertical inner surface, such as surface 55 of dam 50 and surface 56 of dam 51. Since the cooktop recessed areas are formed by drawing the sheet of material forming the cooktop, the inner surfaces of the dams are at some small angle relative to the vertical in order to separate the cooktop from the die. However, the closer the inner surfaces are to vertical, the better they will work.

When grate 24 is inserted into recessed area 22, the outer surface 46 of its base 44 is adjacent to the inner surfaces of the dams 50–54. If a force tends to slide the grate out of the recessed area, to either side or to the front, the opposing vertical outer surface of the grate base and the inner surfaces of the corresponding dams will oppose the movement. If grate 24 tries to slide to the rear, it will engage the grate 25 that, in turn, will engage a dam 58 at the rear of recessed area 20. Thus dams restrain each of the grates from sliding out of the corresponding recessed area in any direction.

Since the bottom edge of each of the grates is fairly close to the top of the first wall of the corresponding recessed area, there is a fairly small area of overlap between each dam and the corresponding portion of the grate base. As an important part of this invention, the size of the overlapping surfaces is increased, to increase the resistance to grate displacement, without increasing the amount of material in the grates. Referring to FIG. 3, grate base 44 is formed with tabs 60–64 aligned with the dams 50–54. The tabs extend those portions outer surface 46 below the remainder of the base outer surface. This increases the area of the base outer surface 46 which overlaps each of the dams 50–54 and thus increases the resistance to sliding the grate out of the recessed area. Conveniently the tabs are coined from the base 44 by compressing those areas of the base. This provides the tabs with a lesser thickness than the remainder of the base, see FIG. 4. If desired, the tabs could be formed as separate members and attached to the grate by a suitable means such as welding. This would add some material to the grate, but the additional material would be small as the tabs do not have to be as thick as the main part of the grate.

As mentioned above, each of the recessed areas and grates is substantially like every other recessed area and grate. Therefore, for the sake of brevity the other recessed area and grates will not be described in detail.

While a specific embodiment of the invention has been illustrated and described herein, it is realized that modifications and changes will occur to those skilled in the art to which the invention pertains. It is therefore to be understood that the appended claims are intended to cover all such modifications and changes as fall within the true spirit and scope of the invention.

What is claimed is:

1. The combination of:

a cooktop having an upper surface and at least one burner opening therethrough, said cooktop including an area recessed downwardly of said upper surface and surrounding said at least one burner opening;

said recessed area having a peripheral portion including a plurality of spaced apart bosses, each of said bosses including a substantially horizontal grate support surface positioned below said cooktop upper surface;

said peripheral portion also including a plurality of spaced apart dams, each of said dams including a substantially vertical inner surface;

at least one utensil supporting grate including an annular base having a substantially vertical outer surface and a bottom edge; said grate also including a plurality of utensil support members extending inwardly of said base;

said at least one grate being positioned within said at least one recessed portion, overlying said at least one burner opening, and with said grate base bottom edge resting on said grate support surfaces of said bosses and with said base outer surface adjacent said inner surfaces of said dams; and said grate base including a plurality of tabs spaced apart along said base and aligned with said dams, said tabs extending downwardly to increase the height of said base at each of said dams.

2. A combination as set forth in claim 1, wherein: said tabs are reduced thickness portions of said grate base.

3. A combination as set forth in claim 1, wherein: said tabs are formed by compressing predetermined portions of said grate base.

4. A combination as set forth in claim 1, wherein: said tabs are formed as separate members and permanently connected to said grate base.

5. A combination as set forth in claim 1, wherein:

said base has a generally rectangular shape;

said bosses are positioned along said recess peripheral portion to support said base in the vicinity of its corners and said dams are positioned along said peripheral portion intermediate said corners of said grate base.

* * * * *